US007552811B2

(12) United States Patent
Wollny

(10) Patent No.: US 7,552,811 B2
(45) Date of Patent: Jun. 30, 2009

(54) METHOD AND DEVICE FOR TESTING COINS

(75) Inventor: Manfred Wollny, Berlin (DE)

(73) Assignee: Walter Hanke Mechanische Werkstatten GmbH & Co. KG, Berlin (DE)

( * ) Notice: Subject to any disclaimer, the term of this patent is extended or adjusted under 35 U.S.C. 154(b) by 234 days.

(21) Appl. No.: 10/546,140

(22) PCT Filed: Feb. 19, 2004

(86) PCT No.: PCT/EP2004/001600

§ 371 (c)(1),
(2), (4) Date: Nov. 4, 2005

(87) PCT Pub. No.: WO2004/075124

PCT Pub. Date: Sep. 2, 2004

(65) Prior Publication Data

US 2006/0163029 A1 Jul. 27, 2006

(30) Foreign Application Priority Data

Feb. 19, 2003 (DE) ..... 103 07 754

(51) Int. Cl.
*G07D 5/00* (2006.01)
*G07D 5/02* (2006.01)

(52) U.S. Cl. ..... 194/328; 194/334

(58) Field of Classification Search ..... 194/328, 194/329, 331, 334; 73/163; 250/559.04, 250/559.05, 559.19, 559.22, 559.24
See application file for complete search history.

(56) References Cited

U.S. PATENT DOCUMENTS 5,988,348 A * 11/1999 Martin et al. ..... 194/317
6,142,285 A * 11/2000 Panzeri et al. ..... 194/328
6,685,000 B2 * 2/2004 Sugata et al. ..... 194/328
6,688,449 B1 * 2/2004 Yamagishi ..... 194/328
6,725,995 B2 * 4/2004 Yamagishi ..... 194/328

(Continued)

FOREIGN PATENT DOCUMENTS

DE 10133854 A1 2/2003

(Continued)

OTHER PUBLICATIONS

English translation of the Abstract of EP-0-892280 A2.

(Continued)

*Primary Examiner*—Patrick M. Mackey
*Assistant Examiner*—Mark Beauchaine
(74) *Attorney, Agent, or Firm*—Young Basile

(57) ABSTRACT

Disclosed is a method and device for testing coins which are placed in a coin acceptor unit and which are displaced in front of an image sensor consisting of lines and columns, whereby said image sensor records an image of the coins that are to be tested. At least one of the front columns in the direction of movement of said coins and/or at least one line of the image sensor captures parameters, which in conjunction with the temporal detection information, are used to provide information on the movement of said coins. It is determined independently from said parameters when the coin will appear in a desired overlap area for recording, whereby the image sensor is shifted into an activation mode of the columns and lines of the overlap area and recording is triggered.

14 Claims, 2 Drawing Sheets

U.S. PATENT DOCUMENTS

2002/0037096 A1* 3/2002 Sugata ..... 382/136

FOREIGN PATENT DOCUMENTS

| | | | |
|---|---|---|---|
| EP | 1 146 489 | A2 | 10/2001 |
| GB | 2369710 | A | 6/2002 |
| JP | 07101204 | | 4/1995 |
| JP | 08297729 | | 11/1996 |
| JP | 2001/230977 | A | 8/2001 |

OTHER PUBLICATIONS

English language translation of International Search Report dated Jun. 16, 2004 (PCT/EP2004/001600).

* cited by examiner

METHOD AND DEVICE FOR TESTING COINS

BACKGROUND OF THE INVENTION

The invention relates to a method and a device for testing coins, in which the image of the coin is detected using an image sensor.

In the process of recognising the embossing on coins there is a known way of using photographic image sensors which usually have pixels arranged in columns and lines. Here it is necessary to determine the correct moment of the recording of the moved objects i.e. the coin (here the term "coin" is used to denote also tokens or counters or the like). One problem is detecting the coin in its unrestricted course of movement and monitoring the run of the coins only with the image recording system present or the image sensor. During the dynamic behaviour of a coin as it passes an image sensor and the production of an image by the optical image sensor, exact analysis of the times of passing through the imaging area and the recording speed of the sensor must be made. It is crucial to determine the correct value for the exposure time and the moment of the recording. Although it is possible in special cases, it is not to be expected that the coin will move through the recording area of the image sensor at a constant speed and certainly will not stay there for a short time at all. There are four time areas to be examined, namely the run-in of the coin into the sensor area, the recording/exposure time, the data transfer or transmission for processing the image in an evaluation device and the image processing, analysis and evaluation. Whilst for the fourth time period no fixed time value is given, apart from the maximum time of the entire process, the first three time periods are extremely time-critical.

Run-in times for selected coins were determined, the run-in time being determined as the time from the appearance of the edge of the coin in the recording area of the image sensor up to complete detection of the coin by this recording area. The measured run-in time was between 4.5 and 9.9 ms and that of 0.01, 0.10, 1 and 2 Euro coins was respectively 4.9, 5.9, 6.99 and 7.71 ms. The aimed-at diameter range of the coins to be measured is between 15 mm and 33 mm. Measurements in real coin checkers produced a maximum coin speed of 3 m/s. With the given time conditions it is inconceivable to follow the run of the coin up to the correct recording position by cyclical scanning of the image. Moreover in such a case the data transfer times from the image sensor to the operating processors is much too long.

SUMMARY OF THE INVENTION

The object underlying the invention is to create a method and a device for testing coins using an image sensor to record an image of the coin to be tested, in which the moment of the recording of the image of the coin or respectively the location of the recording is reliably determined and with which the data transfer times from the image sensor to the evaluation device are minimised.

This object is accomplished according to the invention by the features of the main claim and the subordinate device claim.

The invention exploits the capability of image sensors to select just partial areas. Since the scanning speed of the individual pixels is independent of their number, the transfer speed can be assumed practically proportional to the number of points to be selected. Because only at least one front column in the direction of movement of the coin and/or at least one line of the image sensor detect parameters of the coin, which together with the temporal detection information provide information about the movement of the coin, and because in dependence on these parameters and the temporal information it is determined when the coin will appear in a coverage area, desired for recording, of the image sensor, the image sensor being switched into activation of the columns and lines of the coverage area and the recording being triggered, it is possible to monitor the movement of the coin and to calculate exactly the moment of the actual recording of the image of the coin, and as a result of the activation of only the coverage area of the coin with the image sensor, the time for reading out the image data is reduced.

Advantageous developments and improvements are possible due to the measures quoted in the subordinate claims.

Through detection the apex of the coin by the at least one front column in the direction of movement, the diameter of the coin can be determined, via which information can be provided about the height and width of the coverage area.

By scanning the front edge and the apex of the coin and the temporal information of the scanning and the diameter of the coin, the speed of the coin can be calculated in a simple manner, and especially in the case of small coins which run slowly this speed information is already sufficient to fix the moment of the recording, since the recording area of the image sensor is somewhat larger than the coin surface and thus running out of the sensor area without being checked is unlikely.

It is especially advantageous, after detection of the apex of the coin, to activate at least one line of the image sensor at the level of half the diameter, and to scan the front edge of the coin a number of times, since the speed and/or the acceleration of the coin can be calculated exactly as a function of the scanning times and the distances covered. Thus the recording moment can be determined exactly even if the coin experiences a delay or acceleration in the course of its run-in.

It is advantageous that as the coin runs through the at least one column, the height pattern of the coin is detected and evaluated, grooves being recognised where discontinuities are present in the height pattern.

An illumination device is advantageously provided which is activated in a pulsed manner at the moment of the recording, and thus good illumination can be achieved as a result of the fixing of the moment of the recording, it being possible to determine the length of the illumination as a function of the speed of the coin.

BRIEF DESCRIPTION OF THE DRAWINGS

Embodiments of the invention are represented in the drawings and are explained in greater detail in the following description. The figures show.

DETAILED DESCRIPTION OF THE PREFERRED EMBODIMENT

The device according to the invention is installed in a coin checker, preferably in the coin channel, in which the other measuring systems of the coin checker are also present, and the described device can be configured as a sub-system of the coin checker control system. The device has an image sensor, the term "image sensor" being intended to cover the entire recording device with lens system. In addition, an illuminating device is provided which is associated with the image sensor and which has a flashlight function, i.e. generates pulsed illumination of the coin surface.

Figure 1:
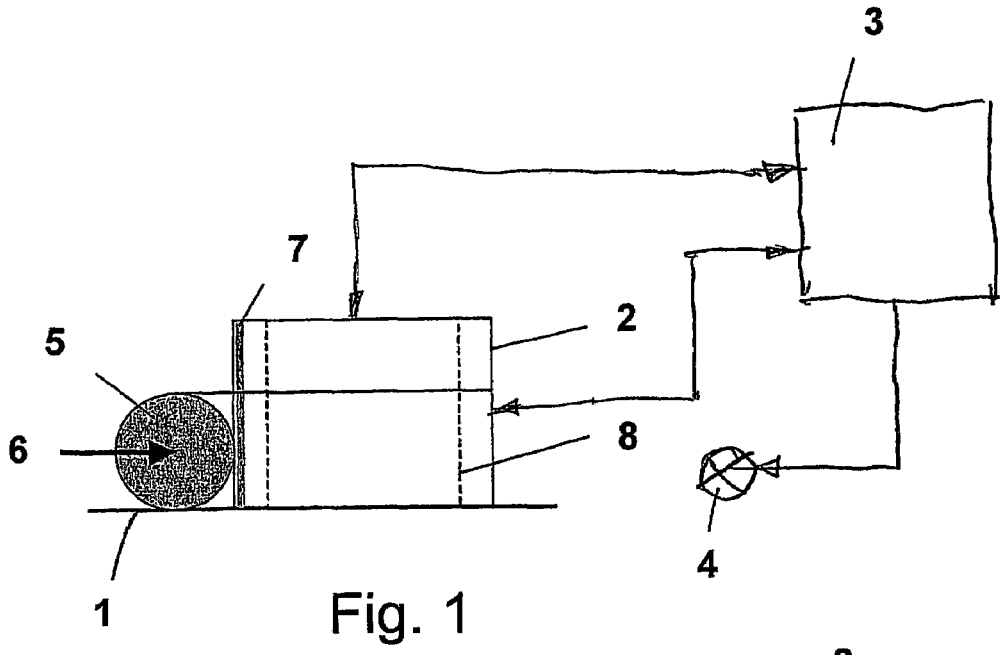
FIGS. 1-4 different states of movement of the coin in relation to an image sensor, and FIGS. 5 and 6 a schematic illustration of the scanning of milled coins.

A device according to the invention is represented schematically in FIG. 1 and has the image sensor 2 arranged in the region of a coin track 1, with an appropriate lens system as well as an evaluation unit 3, which is a constituent part of the coin checker control system, and an illumination assembly 4. The recording device configured as the image sensor 2 is so set with the lens system that a specific visual field and a specific focus area are preset, and a coin 5 to be photographed should be arranged in this area so that no optical distortions or obscuration occur. The image sensor 2, the illustration of which shows the coverage area, is provided with a large number of columns and lines which are formed from pixels and connected to the evaluation unit 3 and which may be triggered individually or in areas by the evaluation unit 3 for their initialisation and activation for the process of reading out the data from the sensor as well as for the actual recording. The recording is the process of "electronically fixing" the optical image, i.e. the optical function as charge carrier is taken over with an electronic "shutter". This happens in as short a period of time as possible in order to avoid movement blurs. As the data are being read out of the sensor, the coin is already moving forward. With the triggering of the lines and columns for the recording, the illumination device 4 is also triggered.

So that an assessable recording of a coin 5 can be achieved, the moment of the recording, based on the movement parameters of the incoming coin 5, must be determined via the evaluation unit 3 at the desired measuring position or at the desired recording location. To this end, in the preferred embodiment at the beginning of the detection only the first column 7 of the image sensor 2 in the direction 6 of movement of an incoming coin 5 is activated, the pixels of this first column 7 being continuously read out by the evaluation unit 3 and the run-in of the coin being awaited. As the coin 5 enters the image sensor, the front edge is detected by the column 7 and recognised by the evaluation unit 3, which activates a height check which is intended to recognise the apex of the coin.

Figure 2:
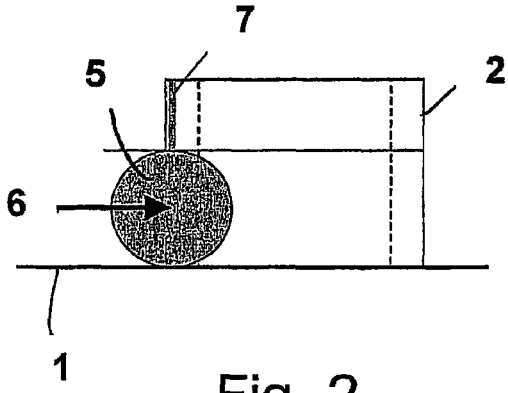

On reaching the apex, according to FIG. 2, the evaluation unit 3 determines the diameter of the coin 5 which is stored as the first measured value of the system. The desired coverage area is fixed from the diameter.

At this point in time, a first assessment of the run-in speed of the coin is possible since a speed can be calculated from the moment of scanning the front edge, the moment of scanning the apex and from the diameter. In the simplest case, i.e. if certain indistinctness is admitted, this information is already sufficient to fix the moment of the recording, which can be calculated from the speed and the desired measuring position. This is true in particular for small coins which run slowly, since the desired recording area 8, represented in broken lines, in this case covers most of the coin surface and thus the coin is unlikely to exit from the sensor area without being checked. If however it is to be expected that the speed will alter as the coin runs in, additional checking of the passage of the coin is necessary.

Figure 3:
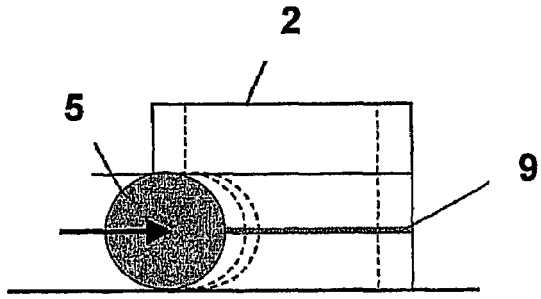
Figure 4:
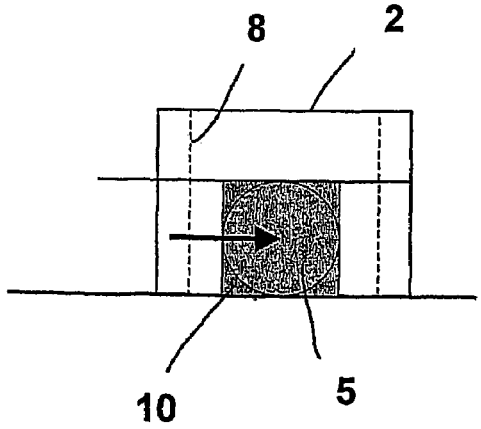

For this additional checking of the passage of the coin, reference is made to FIG. 3, in which a pixel line 9 on the centre line relative to the diameter of the coin 5 is activated. This activation is undertaken by triggering the evaluation unit 3 after recognising the diameter of the coin 5. In this case, the first scanning line 7 can be deactivated. Scanning the front edge of the coin 5 on the centre line provides continuously the progress of the coin as it runs through the system. With the temporal information of the scanning of the front edges and the distances respectively covered, the respective speed and, if desired, the respective acceleration can be determined, which then serve to determine the time of the coin's arrival at the measuring position. As a function of this temporal prediction and/or once the coin 5 has completely entered the designated recording area 8, the lines and columns of the image sensor are initialised in the height and width predetermined by the diameter of the coin 5, as the coverage area at the recording location, by the evaluation unit 3, and triggered at the previously calculated point in time. This is shown in FIG. 4, in which the coin is shown in the desired coverage area 10 with the image sensor. Due to the previously ascertained diameter of the coin and the time at the measuring position, determined from the speed or acceleration, the coverage area of the image sensor 2 which is to be recorded can be selected in an optimum manner.

Depending on the coin size, the coverage area or recording area is limited by the evaluation unit 3 triggering the lines and columns, the time for reading out the image data being reduced to a minimum. If the evaluation of the data is matched to this, in order to save space in the working memory, even the areas of the coverage area 10 which are located outside the circular image can be suppressed, i.e. the signals from these areas are not passed on by the evaluation unit 3.

During the recording according to FIG. 4, the illumination device 4 is simultaneously triggered by the evaluation unit 3, which also determines the exposure time from the previous information about the speed and the diameter. For reproducible illumination, which is as free of shadows as possible, of the coin surface during the recording, a diffuse, even and as bright as possible illumination of the coin is required. This is activated as already mentioned only at the moment of the recording and also in a pulsed manner on account of the high consumption of current.

The illumination for the recording can take the form for example of a plurality of light diodes arranged in a ring with a diffuse reflector.

According to present knowledge, the exposure time of the recording must be controlled with the aid of deliberate control of the illumination. This is necessary since circulating coins have a very strong spectrum of contamination and oxidation and thus reflection capability. Furthermore, for cost reasons, a lens system with a fixed aperture is usually used.

On account of the expected high running speed of the coin, controlling exposure by the exposure time has to be excluded if possible. The exposure must be kept as short as possible in order to avoid movement blurs. There remains the possibility of controlling the current supply to the illumination elements or to a gain control of the image sensor.

In addition to the illumination for the actual recording, illumination for checking the coin run-in is required, which can be configured as point-source or linear illumination with a lower light intensity or energy than the main illumination in that area.

Independently of the demands on the illumination for recording the coin, therefore other illumination techniques can be used in the run-in area, by means of which additional measured values can be obtained, e.g. flat directional, in order to ascertain embossing depths with shadow formation, multi-coloured illumination for recognising two-coloured coins, coloured illumination for recognising the material.

It must also be considered that the illumination for the run-in check has to be activated a number of times if not even constantly over the entire period of the coin run-in.

Naturally this illumination for the run-in check is controlled by the evaluation unit 3, which basically monitors the run-in. Here it can also determine the average brightness of the coin which is used for controlling the exposure.

In certain circumstances, the method can be simplified to remove the recording time by additional checking of the passage of the coin as per FIG. 3 being dispensed with. Then monitoring only via the first column is achieved, the moment of the passage of the first edge and the moment of the passage of the apex, which however cannot be fixed exactly because of the tangential run-in, being determined. The moment of the passage of the rear edge can possibly also be detected. As above, the speed can be determined by using the diameter and the recording moment can be predicted from the speed, and in addition the moment of the passage of the rear edge can be used for checking. The simplified scanning is reliable if the boundary conditions are not so time-critical and the coin movements are continuous enough for exact checking of the coin's running not to be necessary.

As a support to the run-in check in the first column, a column within the scanning area 8 can also be scanned. The time of reaching this position can then be used together with the spacing of the columns in determining the speed.

In certain cases, especially when the diameter ranges of the coins to be detected are similar, monitoring only via one line can be envisaged. But with this monitoring there is the problem of fixing the correct position of the line to be scanned. Therefore a compromise has to be made in respect of precision. Otherwise in this method also the front edge and the rear edge of the coin are detected, it being possible to determine the central position of the coin with this information. In this type of scanning, a larger scanning area of the image sensor is necessary.

There also exist image sensors which do not admit any freely positionable selection of image data, but which make possible reading of pixels in blocks or switching down to a much smaller resolution. In these cases too, the previously mentioned scanning by means of columns and possibly lines can be carried out, the columns and lines then having a reduced number of pixels.

Figure 5:
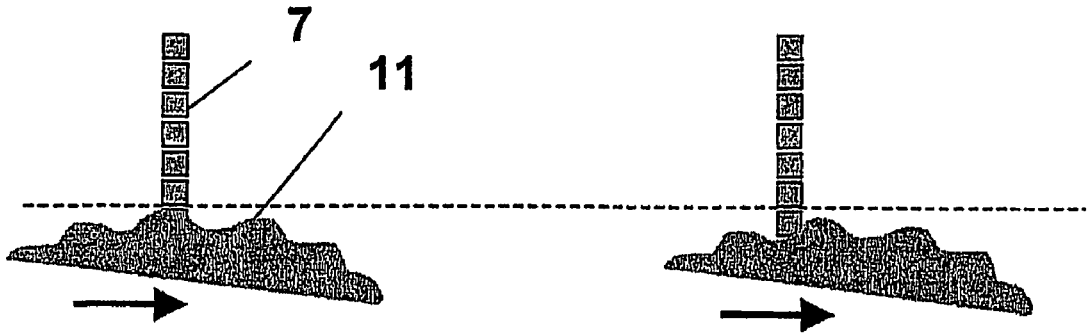
Figure 6:
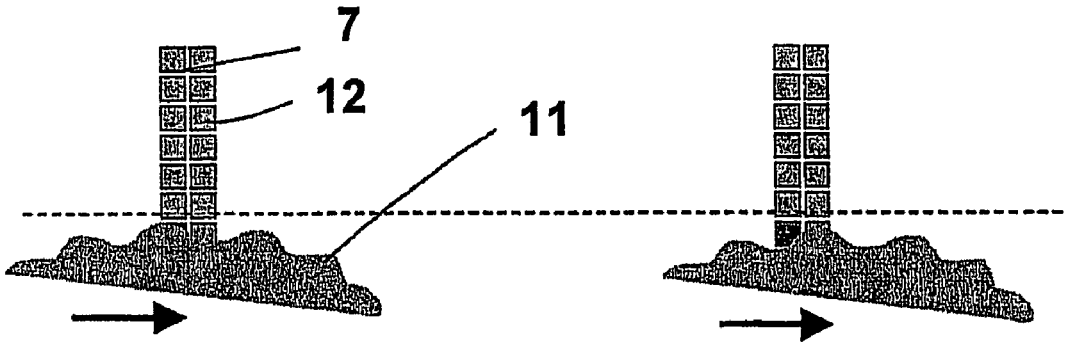

In FIG. 5 and FIG. 6 is represented a so-called groove check, which can be carried out with the preferred embodiment. The entry of the coin into the image sensor or the measuring system is monitored by the rapid scanning of the first column, and the apex of the coin, i.e. its diameter, as mentioned, is determined. When the height pattern is checked, discontinuities can be evaluated as grooves. With the appropriate mathematical correlation, the recognition of polygonal coins is also possible.

As shown in FIG. 5, an enlargement of the upper coin edge 11 as it runs through the first column 7 of the image sensor 2 is illustrated. In the simplest case, only one column is scanned and the repeated change of the uppermost pixel as the apex runs through is recognised as milling. Knowing the speed of the coin, the width of the grooves can also be deduced.

An expanded form having two adjacent columns 7, 12 simplifies the recognition of a groove since then two adjacent pixels respectively supply two negated signals. Their change shows the presence of milling on the edge of the coin 11. For the sake of simplicity, in FIG. 6 the starting point is a groove depth of the dimensions of one pixel of the image sensor. Depending on the resolution of the image sensor, however, the groove depth can also be a plurality of pixels. Then the groove depth becomes a measurable feature of the coin.

The invention claimed is:

1. Method for testing coins which are inserted into a coin checker and run past an image sensor which has lines and columns and which records an image of the coin to be checked, comprising the steps of:

providing information about the movement of the coin with at least one of the front columns in the direction of movement of the coin and at least one line of the image sensor detecting parameters, together with temporal detection information;

determining when the coin will appear in a coverage area of the image sensor as a function of the parameters for recording;

switching the image sensor into activation of the columns and lines of the coverage area; and triggering the recording;

scanning the front edge and the apex of the coin by at least one of the front columns in the direction of movement;

determining the diameter of the coin from the scanning of the apex; and after detecting the apex of the coin, then activating at least one line of the image sensor at the level of half the diameter.

2. Method according to claim 1, further comprising the step of calculating the speed of the coin as a function of the moments of scanning the front edge and the apex as well as of the diameter of the coin.

3. Method according to claim 1, further comprising the steps of scanning in each case the front edge of the coin during run-in and calculating at least one of the speeds and accelerations of the coins as a function of the scanning moments and distances covered.

4. Method according to claim 1, further comprising the step of determining at least one of the time of the arrival of the coin for the recording and the position of the coin for the recording as a function of the speed and the acceleration of the coin.

5. Method according to claim 1, further comprising the steps of detecting and evaluating a height pattern of the coin as the coin runs through the at least one column and evaluating discontinuities in the height pattern as grooves.

6. Method according to claim 5, further comprising the step of determining the groove width once the coin speed is known.

7. Method according to claim 1, further comprising the step of activating an illumination device for illuminating the coin in a pulsed Manner at the time of recording.

8. Method according to claim 1, further comprising the steps of scanning the front edge of the coin by an additional column, which is arranged in the direction of movement of the coin offset to the at least one front column, and calculating the speed of the coin as function of the times of scanning the front edge of the coin and the distance between the columns.

9. Method according to claim 1, further comprising the steps of scanning the front and the rear edges of the coin-by at least one line, activating the columns and lines of the coverage area and triggering the recording as a function of the times of the scanning.

10. Method for testing coins which are inserted into a coin checker and run past an image sensor which has lines and columns and which records an image of the coin to be checked, comprising the steps of:

providing information about the movement of the coin with at least one of the front columns in the direction of movement of the coin and at least one line of the image sensor detecting parameters, together with temporal detection information;

determining when the coin will appear in a coverage area of the image sensor as a function of the parameters for recording;

switching the image sensor into activation of the columns and lines of the coverage area; and triggering the recording;

scanning the front edge and the apex of the coin by at least one of the front columns in the direction of movement;

determining the diameter of the coin from the scanning of the apex;

scanning the front edge of the coin by an additional column, which is arranged in the direction of movement of the coin offset to the at least one front column; and calculating the speed of the coin as a function of the times of scanning the front edge of the coin and the distance between the columns.

11. Method for testing coins which are inserted into a coin checker and run past an image sensor which has lines and columns and which records an image of the coin to be checked, comprising the steps of:

providing information about the movement of the coin with at least one of the front columns in the direction of movement of the coin and at least one line of the image sensor detecting parameters, together with temporal detection information;

determining when the coin will appear in a coverage area of the image sensor as a function of the parameters for recording;

switching the image sensor into activation of the columns and lines of the coverage area; and triggering the recording;

scanning the front edge and the apex of the coin by at least one of the front columns in the direction of movement;

determining the diameter of the coin from the scanning of the apex;

scanning the front and the rear edges of the coin-by at least one line;

activating the columns and lines of the coverage area; and triggering the recording as a function of the times of the scanning.

12. Device for testing coins which are inserted into a coin checker, said device having an image sensor which has lines and columns for recording an image of the coin to be checked and passing the image sensor, and an evaluation device connected to the image sensor, at least one of the front columns in the direction of movement of the coin and at least one line of the image sensor being activated to detect parts of the coin, and the evaluation device determining the desired coverage area from signals of the image sensor and associated temporal information and triggering the image sensor to record, wherein the evaluation device determines the apex and thus the diameter of the coin from the signal of the at least one front column, and wherein the evaluation device activates the lines and columns of the image sensor independently of at least one another and in areas.

13. Device according to claim 12, characterised in that an illumination device is connected to the evaluation unit for pulsed illumination of the image sensor at the time of recording.

14. Device according to claim 12, characterised in that an illumination device is provided to illuminate the coin for a run-in check.

* * * * *